US005579839A

United States Patent [19]

Culpepper

[11] Patent Number: 5,579,839

[45] Date of Patent: Dec. 3, 1996

[54] BULGE CONTROL COMPRESSION PACKER

[75] Inventor: Jess L. Culpepper, Humble, Tex.

[73] Assignee: CDI Seals, Inc., Humble, Tex.

[21] Appl. No.: 446,945

[22] Filed: May 15, 1995

[51] Int. Cl.[6] ..... E21B 23/06

[52] U.S. Cl. ..... 166/118; 166/182; 166/195

[58] Field of Search ..... 166/179, 118, 166/134, 136, 137, 180, 182, 195; 277/34, 34.6; 403/270

[56] References Cited

U.S. PATENT DOCUMENTS

| | | | |
|---|---|---|---|
| 2,828,823 | 4/1958 | Mounce | 277/34.6 |
| 3,003,798 | 10/1961 | Sandlin | 403/270 |
| 3,085,628 | 4/1963 | Malone | 277/34 |
| 3,529,667 | 9/1970 | Malone | 166/387 |
| 4,003,581 | 1/1977 | Hutchison | 166/187 X |
| 4,403,660 | 9/1983 | Coone | 166/179 X |
| 4,406,461 | 9/1983 | McGill | 166/187 X |
| 4,892,144 | 1/1990 | Coone | 166/134 X |
| 5,271,461 | 12/1993 | Decker et al. | 166/185 |

*Primary Examiner*—Frank Tsay
*Attorney, Agent, or Firm*—David M. O'Brian

[57] ABSTRACT

A bulge control compression packer having an elastomeric tubular body and a bulge control member to reinforce the tubular body. The bulge control member including interwoven support elements which generally avoid cutting and gouging the tubular body when the tubular body is in a compressed state and further, generally avoid the accumulation of slack about the bulge control member.

19 Claims, 4 Drawing Sheets

BULGE CONTROL COMPRESSION PACKER

FIELD OF THE INVENTION

The present invention relates generally to a packer for insertion into an annular space in a bore for effectively sealing the bore. Specifically, the present invention relates to a bulge control compression packer for insertion into an annular space in an oil and gas well bore or pipe bore to effectively and efficiently seal the annular space, in the absence of damaging the packer. The bulge control compression packer generally having an elastomeric tubular packer body and a bulge control member which prevents failure of the elastomeric tubular packer body, in the absence of cutting or gouging the tubular body during compression of the packer and in the absence of accumulating slack about the bulge control member.

BACKGROUND OF THE INVENTION

Packers are down-hole tools used to seal annular well and pipe bores in oil and gas wells. A compression packer or expansion packer is a non-inflatable sealing device, generally comprised of elastomeric material which, when compressed at opposing ends, will radiate outwardly to seal the annular space of an oil or gas well or pipe bore. Packers, typically are used in high temperature, high pressure, drilling operations and are generally emersed in drilling muds, caustic chemicals, hydrocarbons and the like. Prolonged exposure of the packer in these extremely hostile environments may lead to packer deterioration and failure. Additionally, compression packers in the past have routinely failed as a result of the tremendous pressure and deformation which is exerted on the packer body, the cutting or tearing of the packer body by the reinforcing elements and the refusal of the packer to contract when the compressive forces have been removed. Compression packers are generally of a cylindrical shape and are longitudinally inserted into a well bore. When the compression packer is at rest, it is in a "free state," and is thus not experiencing compressive forces. When the compression packer is compressed it is referred to as the "compressed state," and the compression packer body changes from a generally cylindrical shape to a rounded shape and radiates outwardly from the center of the annular space to effectively seal the annular space. When the compressive forces are removed from the compression packer, often the compression packer may have become stressed beyond its ability to return to its cylindrical shape. When a compression packer fails, it may cease to provide an effective seal in the annular space or it may refuse to return to its generally cylindrical shape and may become lodged in the annular space. Additionally, compression packers can become damaged as a result of being cut or gouged by the reinforcing members during the compressed state.

Additional problems with conventional compression packers include separation of the packer components, poorly designed reinforcing elements, and the failure of the packer to effectively seal the annular space. Therefore, a need exists for a bulge control compression packer apparatus for efficiently and effectively sealing a pipe bore in an oil and gas drilling well, wherein the bulge control member avoids cutting and gouging of the elastomeric seal body during the compressed state and remains generally free of slack, flat and unfolded at all times. Although the need for such a device has been long felt, the prior art heretofore has not provided such a device which overcomes all of the aforementioned drawbacks.

Additional features and advantages of the invention will be set forth in part in the description which follows, and in part will become apparent from the description, or may be learned by practice of the invention. Features and advantages of the invention may be realized by means of the combinations and steps particularly pointed out in the appended claims.

SUMMARY OF THE INVENTION

To achieve the foregoing features and advantages and in accordance with the purpose of the invention as embodied and broadly described herein, a preferred embodiment bulge control compression packer is presented to efficiently and effectively seal a pipe bore in an oil or gas drilling well, while providing for uniform and repetitious expansion and contraction of the elastomeric packer body, in the absence of damaging the elastomeric packer body. The preferred embodiment bulge control compression packer preferably consists of an elastomeric tubular body having an upper vertical end and lower vertical end; an elastic cover surrounding the elastomeric tubular body; a bulge control member located between the elastomeric tubular body and the elastic cover; a plurality of clamp members circumferentially affixing the bulge control member to the elastomeric tubular body; and at least one adapter mounted to the upper vertical end of the elastomeric tubular body and at least one adapter mounted to the lower end of the elastomeric tubular body. The bulge control member of the present invention generally consists of a tubular braided material having flexible reinforcement capabilities to prevent the tubular body from becoming irreparably deformed during compression, while simultaneously providing contraction capabilities to avoid the accumulation of slack about the bulge control member. The tubular braid material may be composed of a plurality of individual braid elements or strands, which may be selectively constructed of metallic and non-metallic substances. The strands are preferably gathered into a plurality of straps, which are woven to form the tubular braid material. The tubular braid material may preferably be woven using the following patterns: beamed wire braid-plain weave, beamed wire braid-diamond weave, braided braid-plain weave or braided braid-diamond weave, wherein the braid elements are woven having a common lay angle between adjacent straps. The common lay angle will vary upon the specific geometry of the pipe bore to be sealed. For each pipe or well bore geometry and and each packer geometry, there is only one common lay angle for the tubular braid material to be woven, which avoids slack about the tubular body and avoids cutting and gouging of the tubular body in the compressed state. The tubular braid material provides selectively for longitudinal expansion and lateral contraction; and longitudinal contraction and lateral expansion, while reinforcing the tubular body and avoiding permanent deformation to the tubular body. The tubular braid material accomplishes the reinforcement of the tubular body during the compressed state, in the absence of accumulating slack about the tubular body, by providing for uniform changes in the lay angle of the tubular braid material as the compression on the tubular body is increased and decreased.

BRIEF DESCRIPTION OF THE DRAWINGS

The accompanying drawings which are incorporated into and constitute a part of this specification, illustrate a preferred embodiment of the invention and together with the general description of the invention given above and the detailed description of the preferred embodiment given below, serve to explain the principals of the invention.

The above general description and the following detailed description are merely illustrative of the generic invention and additional modes, advantages and particulars will be readily suggested to those skilled in the art without departing from the spirit and scope of the invention.

DETAILED DESCRIPTION OF THE INVENTION

Figure 1:
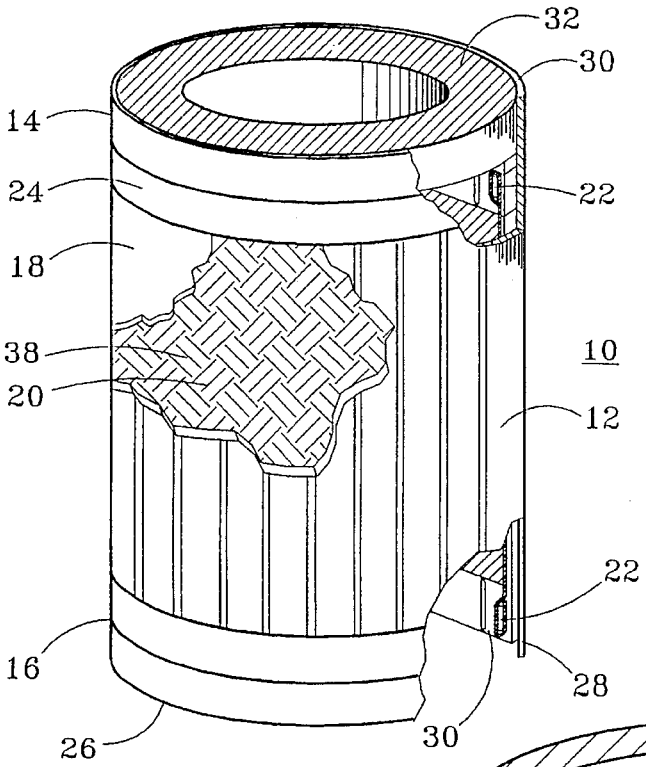
FIG. 1 is a partial cut-away perspective view of a bulge control compression packer in a "free state," embodying the concepts of the present invention.
Figure 3:
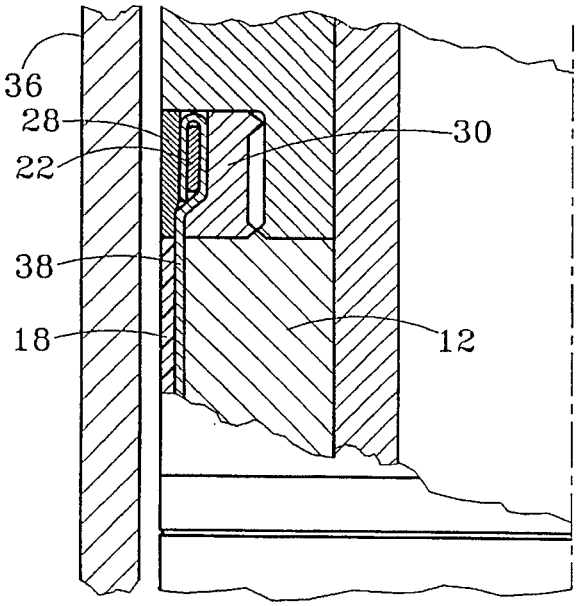
FIG. 3 is a partial cut-away, cross-sectional view of the bulge control compression packer illustrated in a "free state" within a tubular member.

With reference to the drawings wherein like parts are designated by like numerals, FIGS. 1 and 3 illustrate a preferred embodiment bulge control compression packer 10, in the "free state," as defined by the present invention. The bulge control compression packer 10 preferably includes a cylindrical, longitudinally extended, elastomeric tubular body 12 having an upper vertical end 14 and a lower vertical end 16. The bulge control compression packer 10 further includes an elastic cover 18 which surrounds the elastomeric tubular body 12. The bulge control compression packer 10 additionally includes a bulge control member 20 located between the elastomeric tubular body 12 and the elastic cover 18. Further, the bulge control compression packer 10 includes a plurality of clamp members 22 which circumferentially engage the bulge control member 20 to the elastomeric tubular body 12. Additionally, the bulge control compression packer 10 preferably includes at least one adapter 24 affixed to the upper vertical end 14 of the elastomeric tubular body 12 and at least one adapter 26 affixed to the lower vertical end 16 of the elastomeric tubular body 12. The adapters 24, 26 may preferably include an outer peripheral braid adapter 28 and an internal peripheral packer adapter 30, working in combination. The braid adapter 28 functions to secure the clamp member 22 to the tubular body 12. The packer adapter 30 functions to provide a firm surface 32 upon which pressure can be exerted in the form of compression to effect radial, outward expansion of the elastomeric tubular body 12 to seal an annular space 34.

Figure 2:
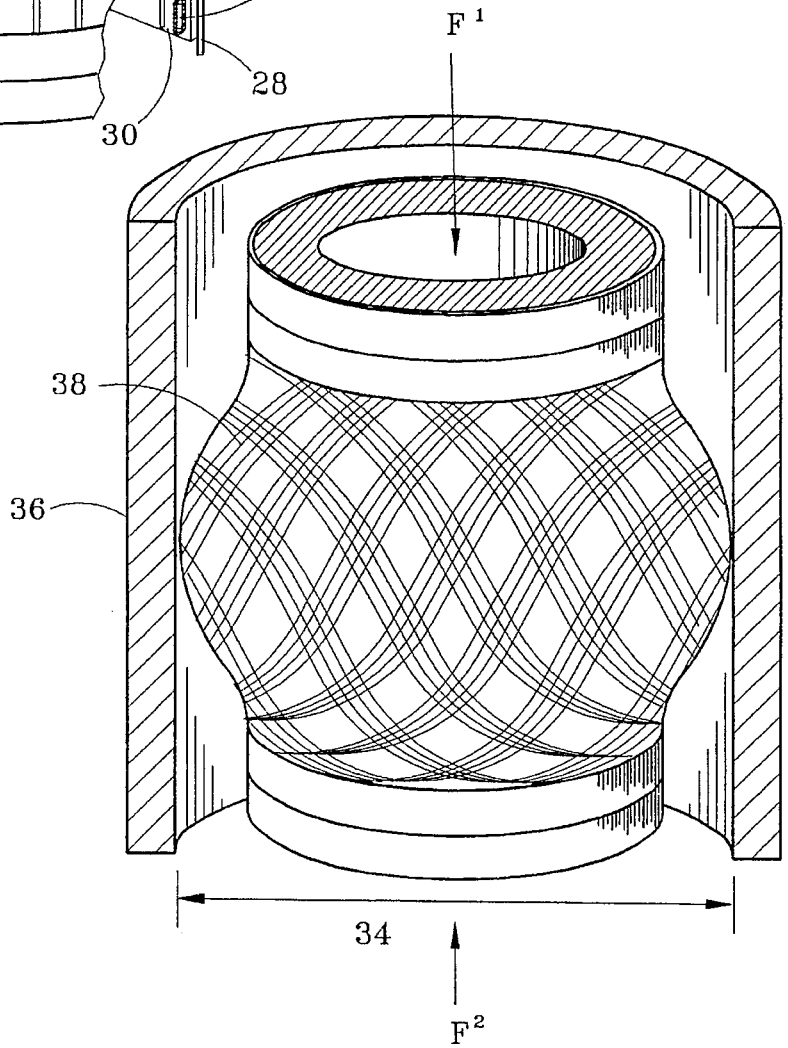
FIG. 2 is a perspective view of the bulge control compression packer shown in FIG. 1, with the elastic cover removed, illustrating the bulge control compression packer in a "compressed state."

With reference to FIG. 2, an expanded bulge control compression packer 10 is illustrated in the compressed state, sealing the annular space 34 of a tubular member 36. When compression is applied to the surfaces 32 of the packer adapter 30, the tubular body 12 expands outwardly in a radial manner to effectively seal the annular space 34.

Figure 4E:
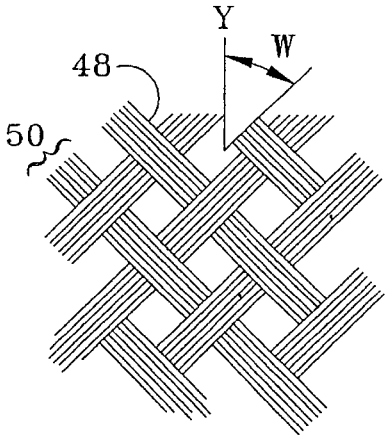
FIG. 4*e* is an enlarged front view of the bulge control member, illustrating the lay angle.
Figure 4A:
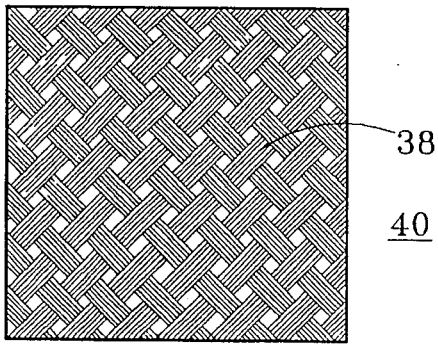
FIG. 4*a* is a front view of the bulge control member constructed of braided braid-plain weave tubular braid material.
Figure 4B:
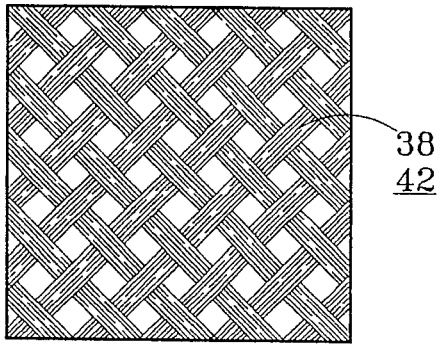
FIG. 4*b* is a front view of the bulge control member constructed of braided braid-diamond weave tubular braid material.
Figure 4C:
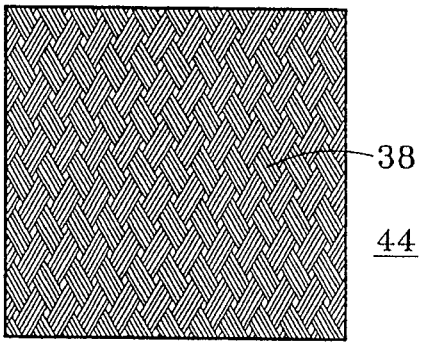
FIG. 4*c* is a front view of the bulge control member constructed of beamed wire braid-plain weave tubular braid material.
Figure 4D:
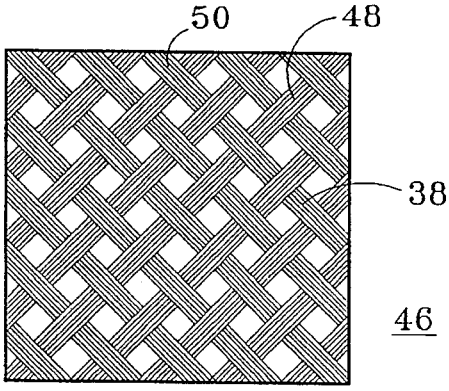
FIG. 4*d* is a front view of the bulge control member constructed of beamed wire braid-diamond weave tubular braid material.

Referring now to FIGS. 1–4*a, b, c, d* and *e*, the bulge control member 20 of the present invention is generally constructed of a tubular braid material 38. FIGS. 4*a–d* illustrate the various configurations of the tubular braid material 38. FIG. 4*a* illustrates the tubular braid material 38 having been configured in a braided braid-plain weave 40. FIG. 4*b* illustrates the tubular braid material 38 having been configured in a braided braid-diamond weave 42. FIG. 4*c* illustrates the tubular braid material 38 having been configured in a beamed wire braid-plain weave 44. FIG. 4*d* illustrates the tubular braid material 38 having been configured in a beamed wire braid-diamond weave 46. The tubular braid material 38 is generally comprised of a plurality of individual braid elements or strands 48 which are gathered to form a plurality of single strap members 50. The individual strands 48 may be selectively constructed of metallic materials, non-metallic materials or a combination thereof. The straps 50, are preferably then woven in either a plain weave pattern 40, 44 or a diamond weave pattern 42, 46, to form the tubular braid material 38. The tubular braid material 38 is generally woven in such a manner as to provide for a particular angular relationship between the straps 50. The straps 50 may be woven together such that the straps 50 are aligned with a vertical plane during the free state, having a common lay angle w, which is defined as an angle that the individual braid element or strand makes with a longitudinal axis Y. The lay angle w will vary according to the geometries of the particular packer 10 and its application with the particular pipe bore 34. When the straps 50 are aligned with the vertical plane during the free state according to the particular lay angle w, which has been determined for the particular packer 10 and the particular pipe bore 34, the straps 50 can adjustably flex to provide for longitudinal expansion and radial contraction of the bulge control member 20 avoiding the accumulation of slack about the bulge control member 20, illustrated in FIGS. 1 and 3, i.e., the free state, and for longitudinal contraction and radial expansion as depicted in FIG. 2, i.e., the compressed state, in the absence of permanently damaging the tubular body 12.

OPERATION

Figure 5:
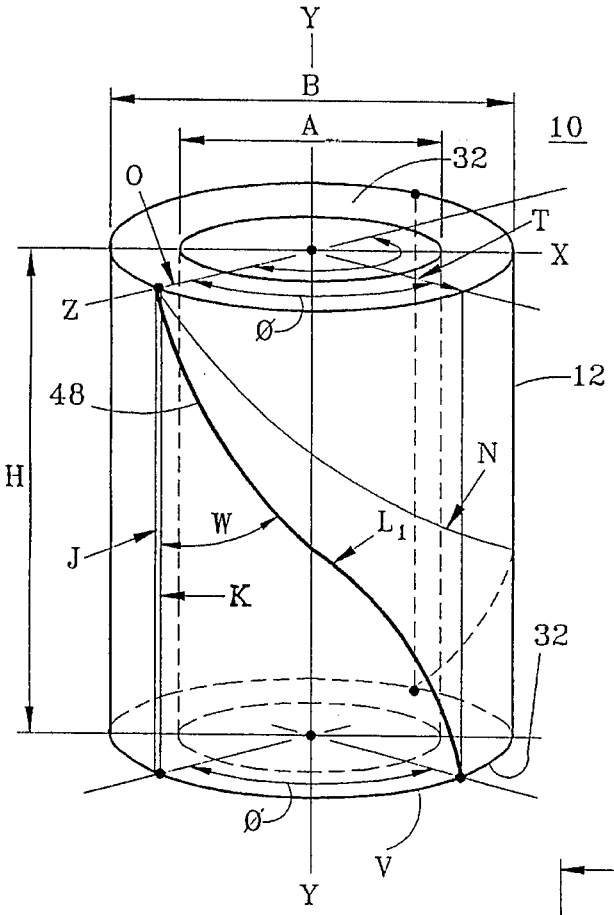
FIG. 5 is a skeletal perspective view of the bulge control packer of FIG. 1, in a "free state."
Figure 7:
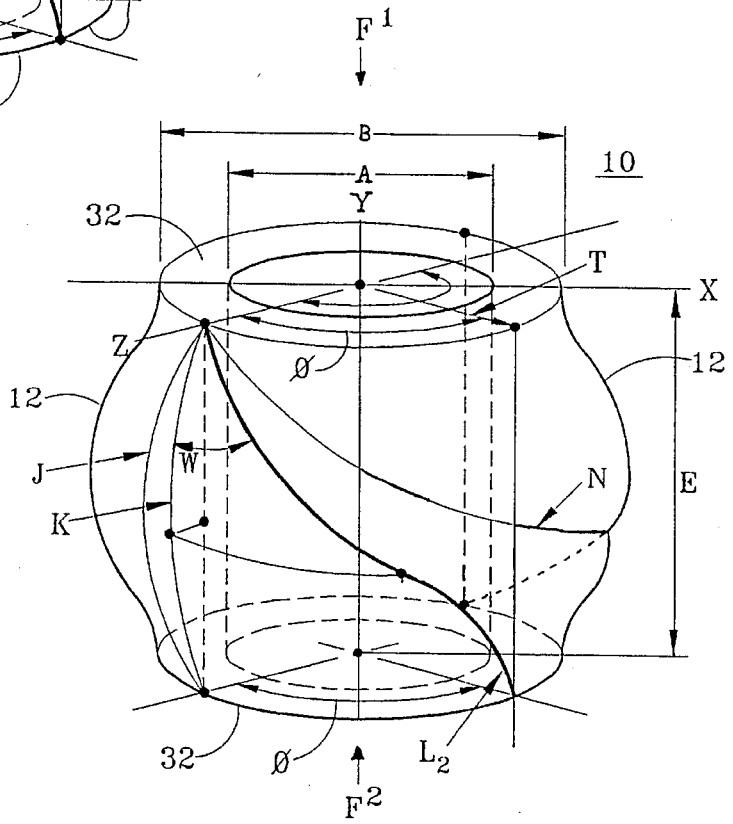
FIG. 7 is a skeletal view of the bulge control packer of FIG. 1, illustrating the "compressed state."
Figure 6:
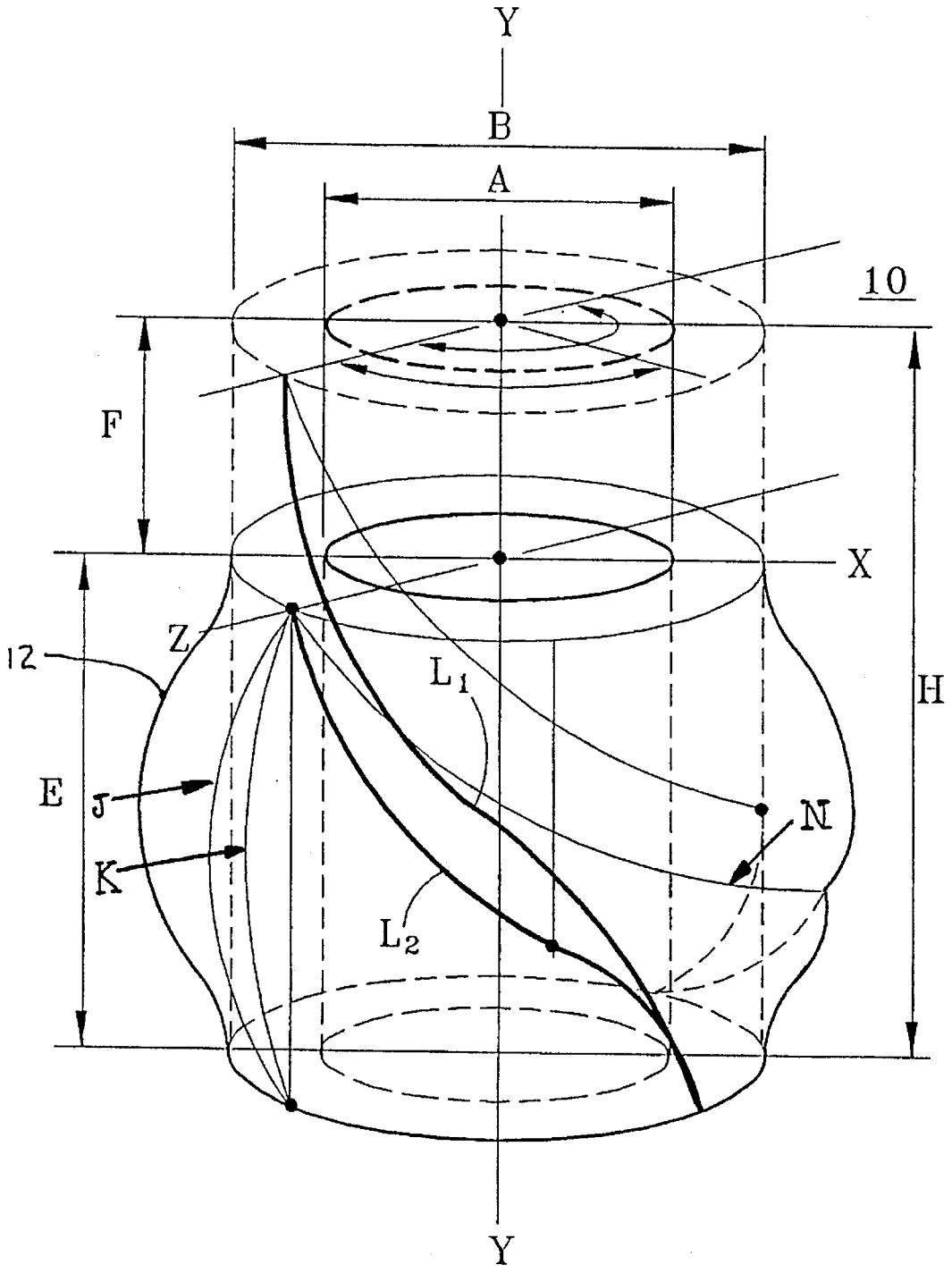
FIG. 6 is a skeletal view of the bulge control packer of FIG. 1, illustrating the transformation from "free state" to "compressed state."

With reference now to FIGS. 1, 3 and 5–7, the function of the bulge control packer 10 is illustrated. As illustrated in FIGS. 5–7, the proper operation of the bulge control packer 10 requires that the bulge control member 20, represented by the individual braid element or strand 48, be permitted to flex, under compression in such a manner that a first helix length $L_1$, also representing the individual braid element or strand 48 during the free state, remains generally equivalent in length to a second helix length $L_2$, representing the individual braid element or strand 48. With reference to FIG. 5, the first helix length $L_1$ is defined by a longitudinal height H of the bulge control packer 10 divided by the cosine of the lay angle w, in other words $L_1$=H/cosine w. The lay angle w must be computed for the particular geometry of the pipe bore 34 to be sealed and the packer 10 to be used. The lay angle w may be computed as follows: w=tan−1 V/H, where V is the volume of the tubular body 12, V=Tϕ and H=the height of the packer 10. T is equal to a radius of the packer 10 and ϕ is equal to an angle defined by the first helix length $L_1$, wherein the first helix length $L_1$ engages the top and bottom compression surfaces 32, as illustrated in FIG. 5. An inner diameter A of the tubular body 12 and an outer diameter B of the tubular body 12 are illustrated in FIGS. 5–7, and remain constant during the free state and the compression state. As illustrated in FIG. 5, the first helix length $L_1$, avoids an accumulation of slack about the tubular body 12. Referring now to FIG. 7, compressive forces $F_1$ and $F_2$ have been applied to the upper and lower firm surfaces 32 of the packer 10 wherein the tubular body 12 expands radially outwards. During compression, as illustrated in FIG. 7, the lay angle w increases, to provide for outward radial expansion of the tubular body 12, in the absence of cutting or gouging the tubular body 12 by the bulge control member 20. The compressed height E of the compressed packer 10 naturally decreases during compression, as illustrated in FIG. 7. In the absence of a properly determined common lay angle w, the individual braid element or strand 48 will cut and/or gouge a cord N, representing a strand 48 of the bulge control member 20, into the tubular body 12, or develop slack and no longer lend support. The proper lay angle w will neither cut into nor develop slack about the tubular body 12, but will remain in perfect harmony with the tubular body 12, as depicted in FIG. 7. The second helix length $L_2$, as illustrated in FIG. 7, has been woven according to the properly calculated common lay angle w and does not cut or gouge into the tubular body 12 nor develop slack during compression.

As illustrated in FIG. 6, the height differential F, is shown comparing the height H of the packer body 10 in the free state and the height E of the packer body in the compressed state. The first and second helix lengths $L_1$, $L_2$ are also simultaneously illustrated in FIG. 6, depicting the radial expansion of the tubular body 12, going from the free state to the compressed state and the length equivalence of the helix lengths $L_1$, $L_2$. As illustrated in FIG. 6, the second helix length $L_2$, under compression, is equivalent in length as compared to the first helix length $L_1$, which is at rest. The first and second helix lengths $L_1$, $L_2$ illustrate the proper lay angle w wherein the bulge control member 20 neither cuts into nor develops slack about the tubular body 12.

With reference now to FIGS. 6 and 7, a cord J, representative of the bulge control member 20, illustrates the accumulation of slack about a surface K of the tubular body 12. The space or slack illustrated between the cord J and the surface K results when the lay angle w is less than the proper lay angle w. The cord N is illustrative of an improper lay angle w in the bulge control member 20, wherein the lay angle w is greater than the proper lay angle w and the tubular body 12 is cut or gouged by the bulge control member 20.

The foregoing description of the invention is illustrative and explanatory thereof. Various changes in the materials, apparatus, and particular parts employed will occur to those skilled in the art. It is intended that all such variations within the scope and spirit of the appended claims be embraced thereby.

What is claimed is:

1. A bulge control compression packer, comprising:

an elastomeric tubular body having an upper vertical end and a lower vertical end;

an elastic cover surrounding said elastomeric tubular body;

a bulge control member located between said elastomeric tubular body and said elastic cover;

a plurality of clamp members circumferentially engaging said bulge control member, each clamp member having an inner surface and an outer surface, said plurality of clamp members being circumferentially engaged to the upper vertical end and the lower vertical end of the tubular body, wherein said plurality of clamp members affix said bulge control member to said elastomeric tubular body;

an upper, outer peripheral adapter and a lower, outer peripheral adapter, both adapters being circumferentially engaged to the outer surfaces of said plurality of clamp members; and an upper, internal peripheral packer adapter and a lower, internal peripheral packer adapter circumferentially affixed to the inner surfaces of said clamp members.

2. The bulge control compression packer, as defined in claim 1, wherein said bulge control member comprises a tubular braid material longitudinally engaged to an exterior surface of said elastomeric tubular body.

3. The bulge control compression packer, as defined in claim 2, wherein the tubular braid material is comprised of a metallic material.

4. The bulge control compression packer, as defined in claim 2, wherein the tubular braid material is comprised of a non-metallic material.

5. The bulge control compression packer, as defined in claim 1, wherein the compression of the bulge control member and the tubular body effectively seals a bore in which the packer has been placed, in the absence of cutting or gouging said tubular body by said bulge control member.

6. The bulge control compression packer, as defined in claim 1, wherein the bulge control member remains generally flat and unfolded in a noncompressed state.

7. The bulge control compression packer, as defined in claim 1, wherein the bulge control member further comprises a plurality of interwoven individual braid elements woven according to a predetermined lay angle to support said elastomeric tubular body.

8. The bulge control compression packer, as defined in claim 7, wherein the plurality of interwoven individual braid elements selectively provide for longitudinal expansion and lateral contraction.

9. The bulge control compression packer, as defined in claim 7, wherein the plurality of interwoven individual braid elements selectively provide for longitudinal contraction and lateral expansion.

10. The bulge control compression packer, as defined in claim 7, wherein the compression of the bulge control member increases a lay angle between the plurality of interwoven individual braid elements and a vertical plane, in the absence of damaging the tubular body.

11. A bulge control compression packer, comprising:

an elastomeric tubular body having an upper vertical end, a lower vertical end and a cylindrical mid-portion depending between and contacting the upper vertical end and the lower vertical end;

an elastic cover surrounding said elastomeric tubular body;

a bulge control member located between said elastomeric tubular body and said elastic cover, wherein said bulge control member includes a tubular braid material longitudinally engaged to an exterior surface of said elastomeric tubular body;

a plurality of clamp members, each clamp member having an inner surface and an outer surface, said plurality of clamp members being circumferentially engaged to the upper vertical end and the lower vertical end of the tubular body, wherein said plurality of clamp members affix the tubular braid material to said elastomeric tubular body;

an upper, outer peripheral braid adapter and a lower, outer peripheral braid adapter, both braid adapters being circumferentially engaged to the outer surfaces of said clamp members; and an upper, internal peripheral packer adapter and a lower, internal peripheral packer adapter circumferentially affixed to the inner surfaces of said clamp members.

12. The bulge control compression packer, as defined in claim 11, wherein the tubular braid material is comprised of a metallic material.

13. The bulge control compression packer, as defined in claim 11, wherein the tubular braid material is comprised of a non-metallic material.

14. The bulge control compression packer, as defined in claim 11, wherein the compression of the bulge control member and the tubular body effectively seals a bore in which the packer has been placed, in the absence of cutting or gouging said tubular body by said bulge control member.

15. The bulge control compression packer, as defined in claim 14, wherein the bulge control member remains generally flat and unfolded in a noncompressed state.

16. The bulge control compression packer, as defined in claim 11, wherein the bulge control member further comprises a plurality of interwoven individual braid elements vertically woven according to a predetermined lay angle to support said elastomeric tubular body.

17. The bulge control compression packer, as defined in claim 16, wherein the compression of the bulge control member increases the lay angle between the plurality of interwoven individual braid elements and a vertical plane, in the absence of damaging the tubular body.

18. The bulge control compression packer, as defined in claim 11, wherein said upper and lower, outer peripheral braid adapters secure said plurality of clamp members to the said tubular body.

19. The bulge control compression packer, as defined in claim 11, wherein said upper and lower, internal peripheral packer adapters provide at least one firm surface upon which an opposing force may be applied.

* * * * *